US012656068B2

(12) United States Patent
Bowler et al.

(10) Patent No.: US 12,656,068 B2
(45) Date of Patent: Jun. 16, 2026

(54) FIN DEVICE, HEAT EXCHANGER HAVING THE SAME AND METHOD FOR MANUFACTURING A FIN DEVICE

(71) Applicant: MAHLE INTERNATIONAL GMBH, Stuttgart (DE)

(72) Inventors: Thomas Allan Bowler, Nashville, TN (US); Scott Edward Kent, Albion, NY (US); Jaroslaw Rozanski, Nowe Skalmierzyce (PL); Tomasz Stelmasinski, Ostrow Wlkp. (PL)

(73) Assignee: MAHLE International GmbH, Stuttgart (DE)

( * ) Notice: Subject to any disclaimer, the term of this patent is extended or adjusted under 35 U.S.C. 154(b) by 269 days.

(21) Appl. No.: 18/233,435

(22) Filed: Aug. 14, 2023

(65) Prior Publication Data

US 2024/0060727 A1 Feb. 22, 2024

(30) Foreign Application Priority Data

Aug. 18, 2022 (DE) ..... 102022208567.1

(51) Int. Cl.
*F28F 1/12* (2006.01)
*F28D 1/053* (2006.01)

(52) U.S. Cl.
CPC ..... *F28F 1/126* (2013.01); *F28D 1/05316* (2013.01); *F28F 2215/00* (2013.01); *F28F 2255/08* (2013.01)

(58) Field of Classification Search
CPC .... F28F 1/126; F28F 2215/00; F28F 2255/08; F28D 1/05316
(Continued)

(56) References Cited

U.S. PATENT DOCUMENTS 5,000,257 A * 3/1991 Shinmura ..... F28F 1/128 165/140
5,033,540 A * 7/1991 Tategami ..... F28F 1/128 165/41

(Continued)

FOREIGN PATENT DOCUMENTS

CN 204924000 U 12/2015
DE 10249451 9/2003

(Continued)

*Primary Examiner* — Claire E Rojohn, III
(74) *Attorney, Agent, or Firm* — Barnes & Thornburg

(57) ABSTRACT

The present invention relates to a fin device for heat exchangers having corrugated fins, which extend along a main direction and comprise fin walls with louvres and fin folds. With respect to the corrugated fins, fin walls that are adjacent in the main direction are each interconnected via a fin fold, while in addition, fin walls that are adjacent in the main direction each delimit between them a fluid channel. Furthermore, the corrugated fins are lined up one behind the other in a transverse direction extending transversely to the main direction, so that the fluid channels (15) of the corrugated fins lead into one another. It is substantial that corrugated fins that are adjacent in the transverse direction are arranged offset to one another in the main direction by a spacing referred to as fin offset and are fixed to one another in that their adjacent fin folds are directly and in particular integrally connected to one another. The present invention, furthermore, relates to a heat exchanger having fin devices and to a method for manufacturing such a fin device.

10 Claims, 3 Drawing Sheets

Figure 1:
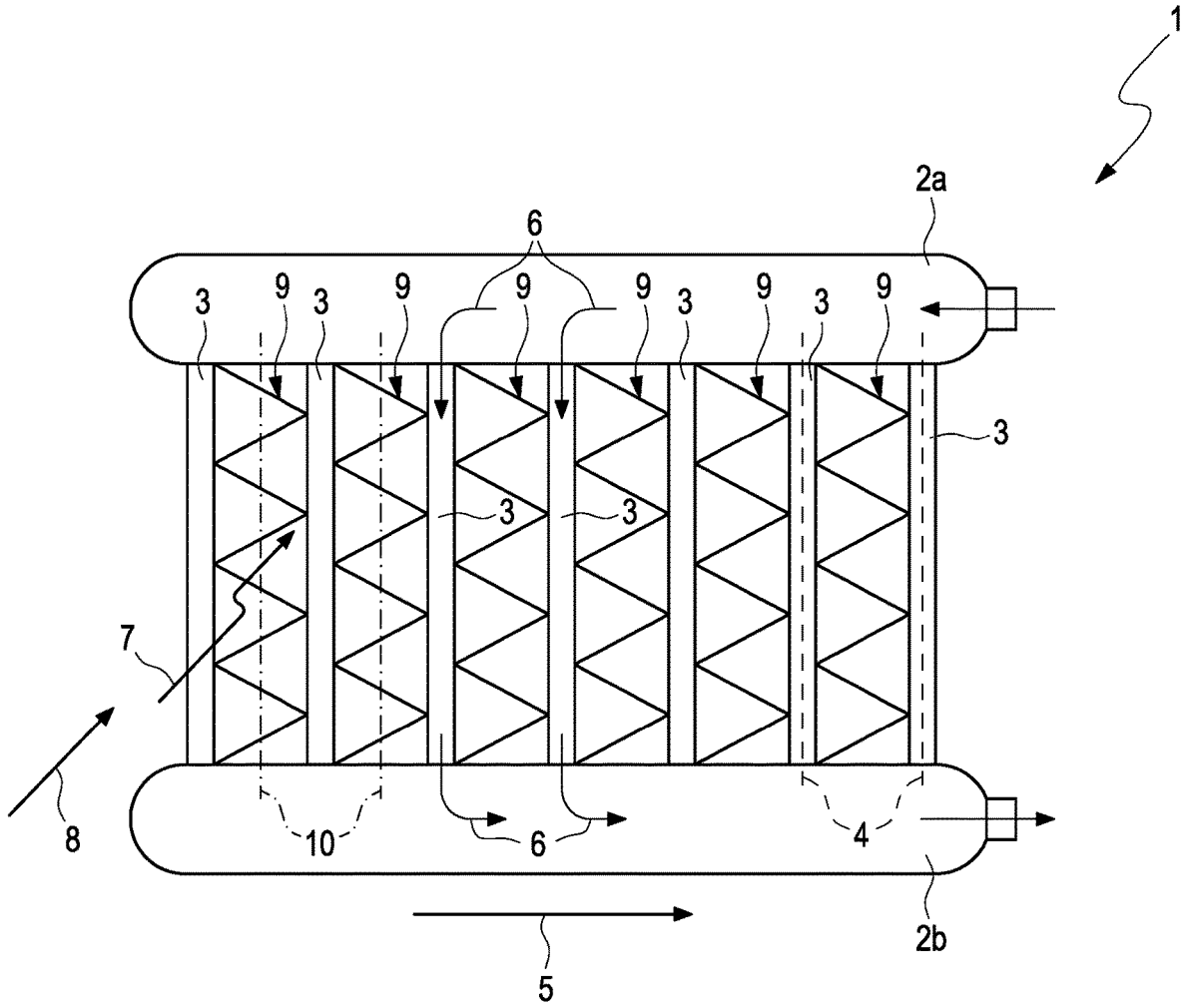

(58) Field of Classification Search
USPC ..... 165/182
See application file for complete search history.

(56) References Cited

U.S. PATENT DOCUMENTS 5,035,052 A * 7/1991 Suzuki ..... F28F 1/325 165/151
5,176,020 A * 1/1993 Maruo ..... F28F 1/128 72/186
5,271,458 A * 12/1993 Yamamoto ..... F28F 1/128 165/152
5,289,874 A * 3/1994 Kadle ..... F28D 1/0535 165/152
5,311,935 A * 5/1994 Yamamoto ..... B60H 1/00328 165/152
5,443,116 A * 8/1995 Hayashi ..... B60H 1/3233 165/149
5,509,199 A * 4/1996 Beamer ..... F28D 1/0435 29/890.07
5,669,438 A * 9/1997 Beales ..... F28F 1/128 165/152
5,787,972 A * 8/1998 Beamer ..... F28F 1/128 165/152
6,209,628 B1 * 4/2001 Sugimoto ..... F28F 1/128 165/146
6,213,196 B1 * 4/2001 Ozaki ..... F28D 1/0435 165/135
6,237,677 B1 * 5/2001 Kent ..... F28F 9/0265 165/110
6,357,518 B1 * 3/2002 Sugimoto ..... F28D 1/0435 165/135
6,439,300 B1 * 8/2002 Falta ..... F25D 21/14 165/152
6,871,399 B2 * 3/2005 Iwasaki ..... F28D 1/0435 29/890.07
7,246,438 B2 * 7/2007 Nozaki ..... F28F 1/128 29/890.047
8,020,298 B2 * 9/2011 Campbell ..... F28F 1/126 29/890.035
8,037,929 B2 * 10/2011 Higashiyama ..... F28F 9/0246 165/172
9,714,794 B2 * 7/2017 Ninagawa ..... F28D 1/05366
9,835,387 B2 * 12/2017 Berta ..... F28F 17/005
9,915,481 B2 * 3/2018 Nakamura ..... F28D 1/05383
10,113,812 B2 * 10/2018 Mabuchi ..... F28F 1/128
10,139,172 B2 * 11/2018 Hunt ..... F28F 1/128
10,309,729 B2 * 6/2019 Bungo ..... F28F 1/128
10,337,799 B2 * 7/2019 Taras ..... F28D 1/0435
10,415,894 B2 * 9/2019 Abrahamian ..... F28F 1/325
12,078,431 B2 * 9/2024 Joardar ..... F28F 1/22
12,228,351 B2 * 2/2025 Morimoto ..... F28F 17/005
2004/0069457 A1 * 4/2004 Park ..... F28F 1/022 165/104.21
2005/0268645 A1 * 12/2005 Kent ..... F28F 9/0246 62/509
2006/0230617 A1 * 10/2006 Kent ..... B21C 37/154 29/890.053
2008/0296008 A1 * 12/2008 Kim ..... F28D 1/0478 165/182
2011/0226454 A1 * 9/2011 Mishiro ..... F24F 13/20 165/173
2014/0338876 A1 * 11/2014 Hokazono ..... F25B 39/022 165/181
2017/0059252 A1 * 3/2017 Zhou ..... F28D 1/047
2020/0018528 A1 * 1/2020 Akaiwa ..... F25B 41/00
2020/0116365 A1 * 4/2020 Komiya ..... F28F 1/20
2020/0149818 A1 * 5/2020 Ishibashi ..... F25B 39/04
2020/0378692 A1 * 12/2020 Zhou ..... F28F 1/04
2021/0071960 A1 * 3/2021 Bando ..... F25B 39/00
2021/0108864 A1 * 4/2021 Yatsuyanagi ..... F28D 1/05366
2022/0065556 A1 * 3/2022 Agata ..... F28F 17/005
2022/0074671 A1 * 3/2022 Zhang ..... F28F 13/003
2022/0250921 A1 * 8/2022 Huang ..... C01G 23/04
2023/0095279 A1 * 3/2023 Hara ..... F28D 1/05366 62/428
2023/0139955 A1 * 5/2023 Huang ..... F28F 17/005 165/133
2023/0314085 A1 * 10/2023 Wang ..... F28F 9/02 165/175
2025/0164195 A1 * 5/2025 Onaka ..... F28F 1/04

FOREIGN PATENT DOCUMENTS

EP 1229296 8/2002
EP 2759797 7/2014
EP 3575728 12/2019

* cited by examiner

FIN DEVICE, HEAT EXCHANGER HAVING THE SAME AND METHOD FOR MANUFACTURING A FIN DEVICE

CROSS REFERENCE TO RELATED APPLICATIONS

This application claims priority from German Patent Application No. DE 10 2022 208 567.1, filed on Aug. 18, 2022, the entirety of which is hereby fully incorporated by reference herein.

The invention relates to a fin device according to the subject of claim 1. The invention relates in particular to a heat exchanger having such fin device and further in particular to a method for manufacturing such a fin device.

Fin device and heat exchangers are known for example from U.S. Pat. No. 6,439,300 B1, CN 204924000 U, EP 3 575 728 A1, EP 2 759 797 A1 or EP 1 229 296 A1.

Disadvantageous in the known fin device is that, because of their delicate construction, they can be merely installed in a heat exchanger with relatively major expenditure, wherein damage to the fin device cannot be entirely excluded. In addition, the fin device that can be flowed about by a fluid flow have a flow resistance the reduction of which is desirable in order to be able ion particular heat exchanger equipped with such fin device in a more sustainable, in particular more energy-efficient manner.

The object of the invention therefore consists in providing an improved or at least another embodiment for a fin device. It is in particular an object of the invention to state a manufacturing method for such a fin device. Further in particular, a heat exchanger having at least one such fin device is to be also stated.

With the present invention, this object is solved in particular through the subjects of the independent claims. Advantageous embodiments are subject of the dependent claims and of the description.

The basic idea of the invention consists in providing a fin device having at least two corrugated fins, in which the corrugated fins are positioned with a specified offset to one another and are connected to one another exclusively via its adjacent fin folds.

To this end, a fin device that can be inserted into a heat exchanger for transferring heat-energy is proposed, which comprises corrugated fins that are offset from one another by a spacing referred to as fin offset, wherein adjacent corrugated fins are connected to one another by way of their fin folds. Because of this, an integral and mechanically stable fin device of corrugated fins for heat exchangers is provided. The term "corrugated fin" according to the invention is to practically mean a row of integrally contiguous folds, wherein each fold comprises fin walls with louvres and fin folds. In particular, a corrugated fin is not an individual fold.

It is practical, furthermore, when a fin device that can be inserted into a heat exchanger is provided for transferring heat-energy, the corrugated fins of which extend each in parallel along a main direction. Furthermore, the corrugated fins each comprise fin walls with louvres and fin folds, wherein fin walls adjacent in the main direction of a respective corrugated fin are connected to one another via a fin fold of the said corrugated fin. The said louvres serve for the heat transfer and practically enlarge the surface area of the corrugated fin contributing to the heat transfer, substantially. Furthermore, fin walls of a respective corrugated fin adjacent in the main direction delimit or form between them a fluid channel in each case. The corrugated fins are lined up one behind the other in a transverse direction running transversely to the main direction, wherein they can in particular touchingly lie against one another, so that the said fluid channels of the corrugated fins that are then adjacent in the transverse direction, open into one another, as a result of which the corrugated fins can be flowed about by a fluid stream in the transverse direction. It is substantial that corrugated fins that are adjacent in the transverse direction are arranged offset to one another in the main direction by a spacing referred to as fin offset and that they are fixed to one another, in that their adjacent fin folds or exclusive their adjacent fin folds are connected to one another. Practically, fin walls that are adjacent in the transverse direction of the corrugated fins that are adjacent in the transverse direction are not connected to one another.

In other words, the fin device according to the invention has two or more corrugated fins that are arranged parallel to and against one another, which practically lie in a common plane, and which are offset relative to one another in their respective main direction by a spacing referred to as fin offset. It is substantial that corrugated fins that are in each case adjacent in the transverse direction, in particular directly adjacent in the transverse direction, are fixed to one another in that merely their fin folds that are adjacent in the transverse direction in particular directly adjacent in the transverse direction are connected to one another. Because of this, an altogether integral and mechanically stable fin device for heat exchangers is provided, which can be easily installed for example in a heat exchanger and in addition to this, because of the realised fin offset between adjacent corrugated fins, can be favourably flowed about by a fluid stream in terms of flow mechanics.

Practically, the corrugated fins that are adjacent in the transverse direction are fixed to one another in that their fin folds that are adjacent in the transverse direction and are located opposite in the transverse direction are directly connected to one another. Furthermore, these fin folds can have fin fold portions located opposite one another in the transverse direction, via which the respective fin folds are directly connected to one another. It can also be provided that the fin folds of the corrugated fins, viewed in the main direction, alternately form crest folds and valley folds, wherein crest folds that are adjacent in the transverse direction of corrugated fins that are adjacent in the transverse direction are directly connected to one another and/or wherein valley folds that are adjacent in the transverse direction of corrugated fins that are adjacent in the transverse direction are directly connected to one another. In particular, it can also be provided that all fin folds that are adjacent in the transverse direction of the corrugated fins that are adjacent in the transverse direction are connected to one another.

In particular, a flow-mechanical phenomenon, which is referred to as duct flow, can be completely or at least largely prevented because of the realised fin offset. This phenomenon describes the case in which a corrugated fin, because of its given geometrical configuration in a fluid channel flowed about by a fluid stream delimited between two adjacent fin walls has or forms a flow region, in which the fluid stream has a flow velocity, which compared with a flow velocity of the fluid stream near a fin wall, that is high in a flow region near the fin wall. This is also referred to a duct flow since fluid in this flow region with high flow velocity can more rapidly pass through the corrugated fin than fluid in a flow region near a fin wall with lower flow velocity. In this case, the fluid stream comes into contact with the channel walls and the louvres only to a reduced degree so that the heat transfer that is achievable by means of a corrugated fin is limited or the geometrical configurations for corrugated fins are limited to such geometrical configurations which do not exhibit any flow region with duct flow. As mentioned at the outset, a duct flow however can be largely prevented because of the fin offset realised here, so that the region for geometrical configurations for corrugated fin is substantially enlarged.

The said corrugated fins are for example corrugated fins. They can be configured so as to be triangular, corrugated or zig-zig shaped. The fin folds of the corrugated fins can be in particular bent, folded, kinked or otherwise embodied as transformed. Except for the louvres arranged thereon, the fin walls are practically configured flat in each case. Furthermore, it can be practically provided that the fin walls and fin folds extend in the transverse direction transversely to the main direction.

Furthermore, it can be provided that the fin device has an even or uneven number of corrugated fins. Further, the corrugated fins, viewed transversely to the main direction, i.e. in the direction of the transverse direction, can be embodied differently wide.

Practically it can be provided, that the fin device forms an integral unit. This can mean in particular, that the corrugated fins that are adjacent in the transverse direction are connected directly and integrally to one another via their fin folds that are adjacent in the transverse direction. For example, the fin device, for this purpose, is manufactured from an integral starting material, in particular a sheet metal material. Because of this, the fin device realises a mechanically stable unit which advantageously can be installed relatively easily. In particular, there is no risk that as part of the installation, corrugated fins break off or the fin device breaks apart.

Further practically, it can be provided, that the said fin offset is defined as a spacing to be defined in the main direction between two adjacent interconnected fin folds of corrugated fins that are adjacent in the transverse direction. It is practical when the fin offset amounts to at least 25% of a longitudinal spacing to be defined in the main direction between two adjacent fin folds of a corrugated fin of the said adjacent corrugated fins or the fin device. Furthermore, it can be practical when the fin offset amounts to maximally 50% of a longitudinal spacing to be defined in the main direction between two adjacent fin folds of a corrugated fin of the said adjacent corrugated fins. By realising the said fin offset, the corrugated fins that are adjacent in the transverse direction can be oriented in the main direction differently to one another. Practically, the fin walls of the corrugated fins that are adjacent in the transverse direction do not lie opposite one another in the transverse direction. Here it can be provided that by way of the said fin offset on or in the region of a boundary surface formed between the corrugated fins that are adjacent in the transverse direction, a drainage region for discharging condensate can be realised on the adjacent corrugated fins. Practically, the fluid channels of the corrugated fins open into one another in the drainage region. By means of the drainage region, condensate, which precipitates on the corrugated fins, can be quasi discharged also between the corrugated fins. Because of this, condensate can more quickly flow away from the louvres arranged on the fin walls so that the heat transfer function of these is less severely influenced by precipitating condensate than in the past. When the fin offset amounts to at least 25% and maximally 50% of the longitudinal spacing between adjacent fin folds of a respective corrugated fin, the setting angle of the louvres can still be reduced relative to the fin walls without their losing thermal effectiveness. Because of this, the louvres project less far into the fluid channels. This has the advantage that the corrugated fins with constant or greater heat transfer capacity have a lower flow resistance, as a result of which the proposed fin device can work comparatively energy efficiently.

In particular, the fin offset and/or the drainage region, viewed in the transverse direction, can be realised in the middle or at least in the region of the middle of a component depth of the fin device extending in the transverse direction. Practically, the corrugated fins, for this purpose, have a, viewed in the transverse direction, same corrugated fin width. However, it is clear that the corrugated fins can also be manufactured with different corrugated fin widths, as a result of which the fin offset and/or the drainage region can also be arranged out of centre.

Practically it can be provided, that the interconnected fin folds that are adjacent in the transverse direction of corrugated fins that are adjacent in the transverse direction comprise or realise at least one of the following characteristics:

- they are arranged on a first large side of the fin device, which is defined or formed by a component depth of the fin device viewed in the transverse direction and a component width of the fin device viewed in the main direction,
- they are additionally arranged on a second large side of the fin device which, with respect to the first large side, is arranged opposite,
- they lie in a common plane which is optionally parallel to the main direction, and further optionally is orthogonal to the first large side and second large side.

By way of this, preferred embodiments for interconnected fin folds are stated.

Further practically it can be provided, that the fin walls that are adjacent in the transverse direction of corrugated fins that are adjacent in the transverse direction delimit a gap between them. By way of this, the adjacent in particular directly adjacent fin walls of corrugated fins that are adjacent to one another are separated from one another. The gaps can extend over an entire wall height of the fin wall. The gaps can realise fluid gaps in particular airgaps.

Practically, it can be provided, that the corrugated fins are manufactured from an integral sheet metal material or a layer composite material, in particular a sheet metal composite material manufactured from individual sheet metal layers. By way of this, the fin device can be manufactured relatively cost-effectively and in large quantities.

According to a further basic idea of the invention, a heat exchanger for transmitting heat-energy between two fluid flows, which with tubes arranged between opposite collector boxes for fluid, in particular flat tubes that are oriented parallel to one another and/or which in their main extension direction define a tube longitudinal direction, which are arranged transversely to their tube longitudinal direction spaced apart from one another in a width direction, wherein a first fluid path for a first fluid stream leads through the tubes and a second fluid path for a second fluid stream leads round about the same. Because of this, the tubes can be flowed through or are flowed through by the first fluid stream and can be flowed through or are flowed through by the second fluid stream, as a result of which heat-energy can be transferred from the first fluid stream to the second fluid stream or vice versa. Further, the heat exchanger comprises fin devices according to the present description, which are equipped for the transfer of heat-energy between the first fluid stream and the second fluid stream. The fin devices are each arranged in the second fluid path and, in a depth direction extending transversely with respect to the tube longitudinal direction and the width direction, which is parallel to the transverse direction, can be flowed about or is flowed about by the second fluid stream. Furthermore, the fin devices are each connected to at least one tube or oriented with its main direction parallel to the tube longitudinal directions and positioned between two tubes that are adjacent in the width direction and connected to the same. Because of this, a heat exchanger equipped with multiple fin devices is stated, which makes possible an efficient transfer of heat-energy between the two fluid streams.

In this connection it can be practically provided, that a drainage region realised by a fin device, viewed in the depth direction, is arranged in the middle or at least in the region of the middle of a heat exchanger component depth of the heat exchanger. Because of this, condensate can be discharged in a specified or specifiable middle position of the heat exchanger.

According to a further basic idea of the invention, a method for manufacturing a fin device according to the above description can be provided, which comprises or includes a roll-forming step and/or a stamping step. By roll-forming and/or stamping, a starting material, for example a flat sheet metal material, can be relatively quickly transformed into an integral fin device, so that the manufacture of the fin devices proposed here also satisfies the most modern production requirements in particular with a view to specified cycle times.

The invention interprets the term "directly" practically in the sense of "direct", "without intermediate element" or "without intermediate space". Furthermore, the invention interprets the expression "fin folds adjacent in the transverse direction" practically in the sense that only such fin folds are adjacent to one another which lie opposite one another at least in portions and which overlap one another transversely to the transverse direction at least in portions.

In summary it remains to note: the present invention practically relates to a fin device for heat exchangers having corrugated fins, which extend along a main direction and comprise fin walls with louvres and fin folds. With respect to the corrugated fins, fin walls that are adjacent in the main direction are each connected to one another via a fin fold while fin walls that are adjacent in the main direction each delimit a fluid channel between them. Furthermore, the corrugated fins are lined up one behind the other in a transverse direction extending transversely to the main direction, so that the fluid channels of the corrugated fins lead into one another. It is substantial that corrugated fins that are adjacent in the transverse direction are arranged offset to one another in a main direction by a spacing referred to as fin offset and are fixed to one another in that their adjacent fin folds are directly and in particular integrally connected to one another. The present invention, furthermore relates to a heat exchanger having fin devices and to a method for manufacturing such a fin device.

Further important features and advantages of the invention are obtained from the subclaims, from the drawings and from the associated figure description by way of the drawings.

It is to be understood that the features mentioned above and still to be explained in the following cannot only be used in the respective combination stated but also in other combinations or by themselves without leaving the scope of the present invention.

Preferred embodiments of the invention are shown in the drawings and are explained in more detail in the following description, wherein same reference numbers relate to same or similar or functionally same components.

It shows, in each case schematically

FIG. 1 in a plan view, a heat exchanger having multiple installed fin devices, FIG. 2 a fin device viewed obliquely from above and FIG. 3 a sectional view of the fin device from FIG. 2 viewed from below.

Figure 2:
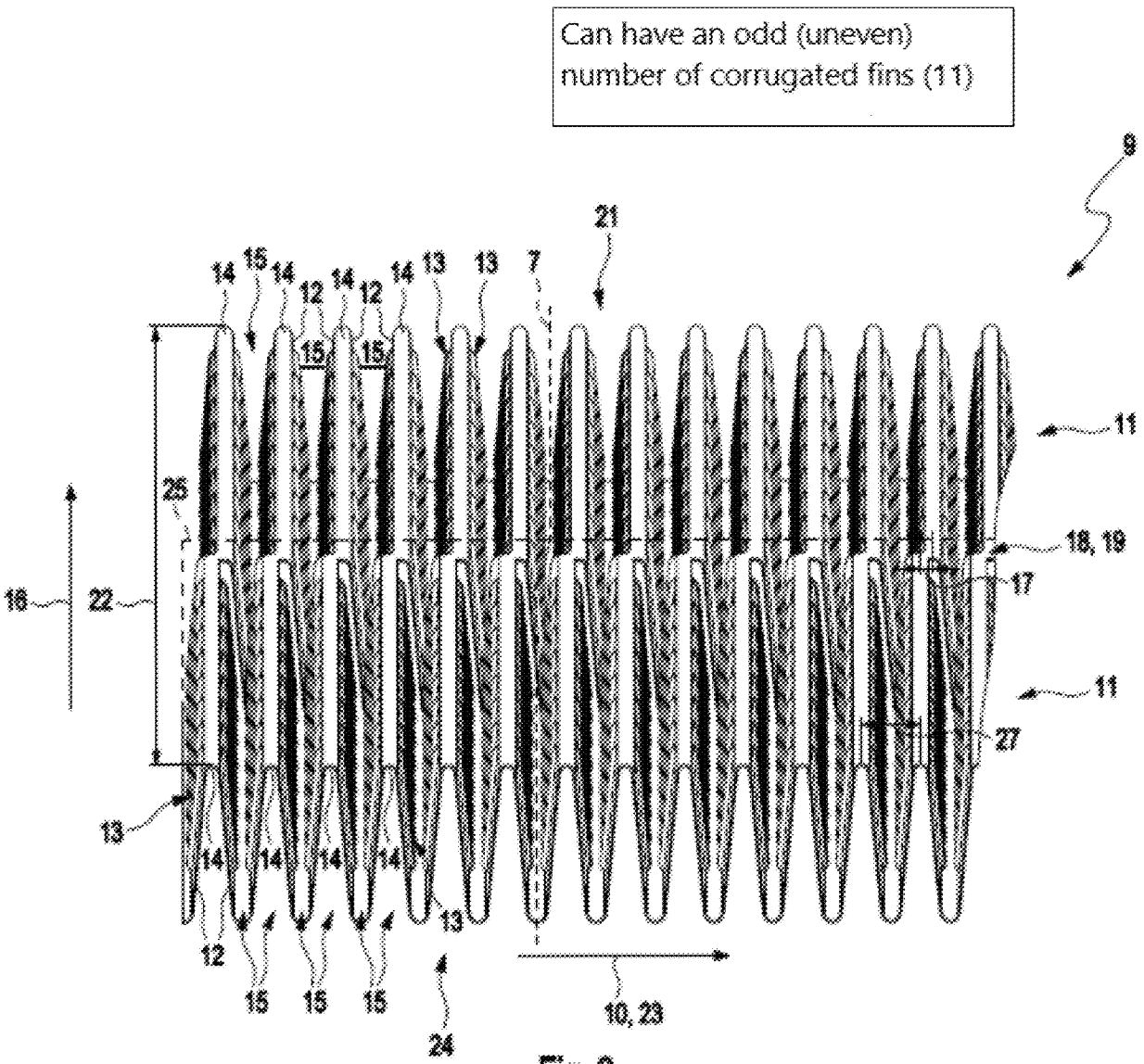
Figure 3:
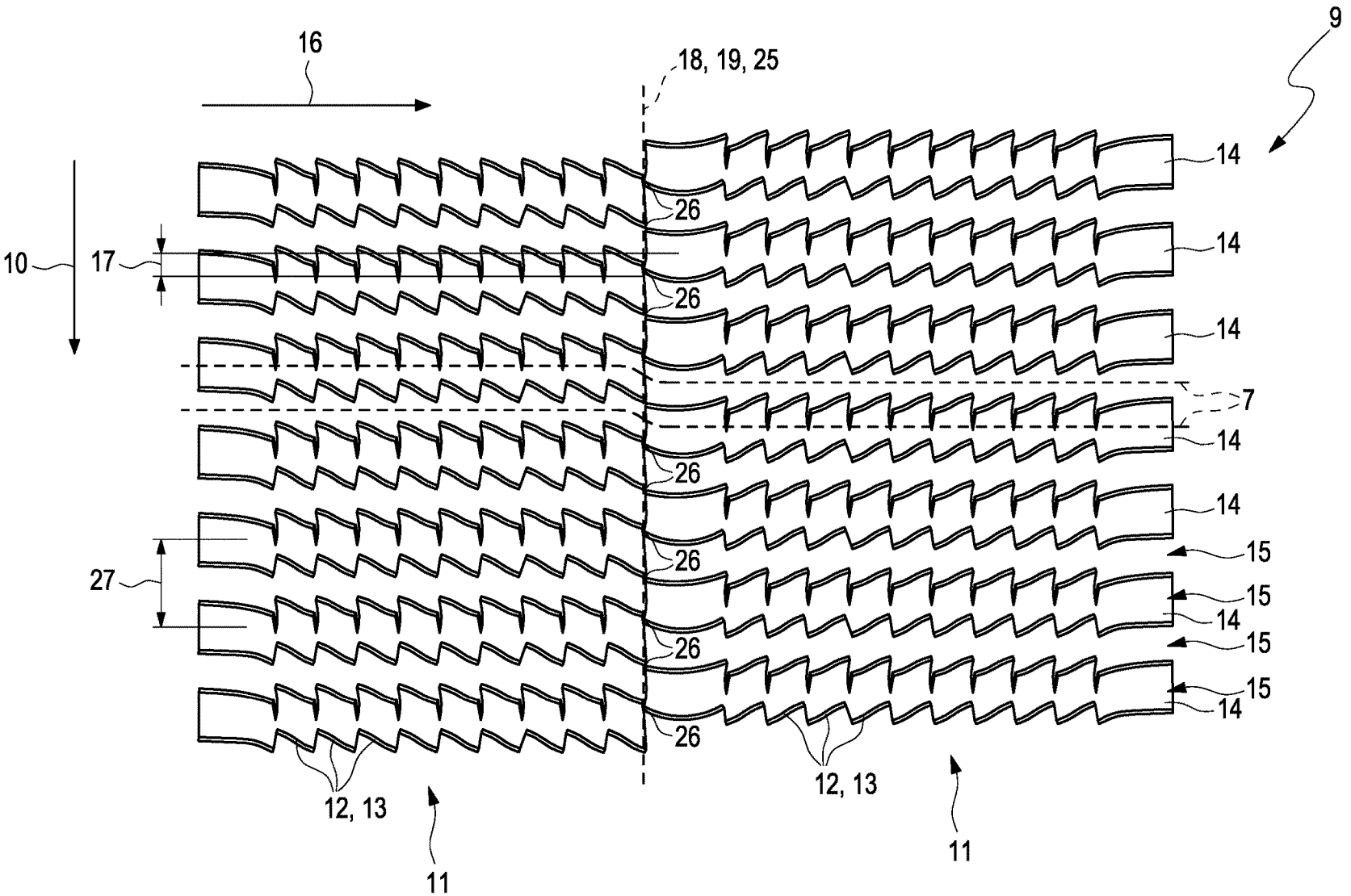

FIGS. 1 to 3 show a preferred embodiment of a heat exchanger marked in totality by the reference number 1, which is equipped with multiple fin devices 9 for transferring heat-energy.

The heat exchanger 1 comprises two separate collector boxes 2*a*, 2*b* located opposite one another, between which tubes 3 are arranged, which are fastened to the collector boxes 2*a*, 2*b* transversely to their tube longitudinal direction 4 in a width direction 5 spaced apart from one another. A fluid path 6 for a first fluid stream indicated by arrows in FIG. 1 leads through the tubes 3. Further, a second fluid path 7 for a second fluid stream leads round about the same, which in FIG. 1 is merely indicated by a single corresponding further arrow. The tubes 3, which can be realised in particular by flat tubes, can thus be flowed through by the first fluid stream and flowed about by the second fluid stream, so that heat-energy from the first fluid stream can be transferred to the second fluid stream or vice versa.

Furthermore, the heat exchanger 1 has multiple fin devices marked with the reference number 9 and each embodied integrally, which are equipped for transferring heat-energy between the first fluid stream and the second fluid stream. The fin devices 9 described in more detail further down below are each arranged in the second fluid path 7 and, in a depth direction 8 extending transversely with respect to the tube longitudinal direction 4 and the width direction 5 can be flowed about by the second fluid stream. In FIG. 1, it is purely exemplarily provided that the fin devices 9, which extend along main directions 10, are each oriented with their main direction 10 parallel to the tube longitudinal direction 4 and are positioned between two tubes 3 that are adjacent in the width direction 5 and are connected to the same tubes 3. Because of this, a heat exchanger 1 that is equipped with multiple fin devices 9 is stated, which makes possible an efficient transfer of heat-energy between the two fluid streams.

The FIG. 2 shows an extract of a fin device 9 from FIG. 1 viewed obliquely from above, wherein components of the heat exchanger 1 are omitted for better visibility of the fin device 9. The illustrated fin device 9 exemplarily has two corrugated fins 11 that are substantially embodied identically, which extend parallel along a main direction 10. Each of the corrugated fins 11 has flat fin walls 12 with rows of louvres 13 and fin folds 14. With respect to the corrugated fins 11, fin walls 12 that are adjacent in the main direction 10 are ach integrally connected to one another via a fin fold 14. Further, fin walls 12 that are adjacent in the main direction 10 delimit or form with respect to the corrugated fins 11 a fluid channel 15 each. Furthermore, it is visible that the two corrugated fins 11 are lined up one behind the other in a transverse direction 16 extending transversely to the main direction 10, so that they are located opposite one another in the transverse direction 16 and so that their fluid channels 15 lead into one another, as a result of which the corrugated fins 11 can be flowed about by the second fluid stream in the transverse direction 16. In FIG. 2, a portion of the second fluid path 7 for the said second fluid stream is exemplarily drawn in.

Furthermore, it is evident in FIG. 2 that the two corrugated fins 11 that are adjacent in the transverse direction 16 are arranged offset to one another in the main direction 10 by a spacing referred to as fin offset 17 and are fixed to one another, in which exclusively their fin folds 14 that are adjacent in the transverse direction 16 are directly connected to one another. The fin offset 17 is a spacing to be defined or determined in the main direction between 2 interconnected fin folds 14 that are adjacent in the transverse direction 16 of the corrugated fins 11 that are adjacent in the transverse direction 16. For example, the fin offset 17 can be determined in that the spacing in the main direction 10 is measured between a fold centre of a respective fin fold 14 of a first corrugated fin 11 of the two corrugated fins 11, for example in FIG. 2 the front corrugated fin 11, to a fold centre of a respective fin fold 14 of a second corrugated fin 11 of these two corrugated fins 11, for example in FIG. 2 the rear corrugated fin 1. The same is drawn in in FIG. 2. Practically, the fin offset 17 amounts to at least 25% and maximally 50% of a longitudinal spacing 27 to be likewise defined or determined in the main direction 10 between two adjacent fin folds 14 of a corrugated fin 11, i.e. either the first corrugated fin 11 or the second corrugated fin 11 of the two adjacent corrugated fins 11. Because of this, an altogether integral, mechanically stable fin device for heat exchangers is provided, which because of the realised fin offset between adjacent corrugated fins, from a flow-mechanical point of view, can be favourably flowed about by fluid or a fluid stream of fluid.

The interconnected fin folds 14 that are adjacent in the transverse direction 16 of the two corrugated fins 11 that are adjacent in the transverse direction 16 are configured so that they are arranged on a first large side 21 of the fin device 9, which is defined or formed by a component depth 22 of the fin device 9 viewed in the transverse direction 16 and a component width 23 of the fin device 9 viewed in the main direction 10, and additionally on a second large side 24 of the fin device 9 arranged opposite with respect to the first large side 21. Further, the interconnected fin folds 14 lie in a common plane 25 only illustrated in portions, which exemplarily is parallel to the main direction 10 and orthogonal to the first large side 21 and second large side 24.

In FIGS. 2 and 3 it is noticeable, furthermore, that by way of the said fin offset 17 on or in the region of a boundary surface 18 formed between the two corrugated fins 11 that are adjacent in the transverse direction 16 on the adjacent corrugated fins 11 a drainage region 19 for discharging condensate is realised, which can precipitate on the fin devices 9 during the operation of the heat exchanger 1. However, it should be mentioned that the fin walls 12 that are directly adjacent in the transverse direction 16 and located opposite one another of the two corrugated fins 11 that are adjacent in the transverse direction 16, each form a gap 26 between them.

The specification can be best understood with reference to the following Numbered Paragraphs:

Numbered Paragraph 1. A fin device (9) that can be inserted into a heat exchanger (1) for transferring heat-energy, comprising multiple corrugated fins (11), which are offset to one another by a spacing referred to as fin offset (17) and fixed to one another in that their fin folds (14) are connected to one another.

Numbered Paragraph 2. The fin device (9) according to Numbered Paragraph 1, characterised in that the corrugated fins (11) extend parallel along a main direction (10), the corrugated fins (11) comprise fin walls (12) with louvres (13) and fin folds (14), wherein fin walls (12) that are adjacent in the main direction (10) are each interconnected via a fin fold (14) and in the case of which fin walls (12) that are adjacent in the main direction (10) each delimit or form a fluid channel (15), wherein the corrugated fins (11) are lined up one behind the other in a transverse direction (16) extending transversely to the main direction (10), so that the fluid channels (15) of the corrugated fins (11) lead into one another, as a result of which the corrugated fins (11) can be flowed about by a fluid stream in the transverse direction (16), wherein corrugated fins (11) that are adjacent in the transverse direction (16) are arranged offset to one another in the main direction (10) by the spacing referred to as fin spacing (17) and fixed to one another in that their fin folds (14) that are adjacent in the transverse direction (16) are directly connected to one another.

Numbered Paragraph 3. The fin device (9) according to Numbered Paragraph 1 or 2, characterised in that the fin device (9) forms an integral unit.

Numbered Paragraph 4. The fin device (9) according to any one of the preceding Numbered Paragraphs, characterised in that the said fin offset (17) is defined as a spacing to be defined in the main direction (10) between two adjacent interconnected fin folds (14) of corrugated fins (11) that are adjacent in the transverse direction (16), wherein the fin offset (17) amounts to at least 25% of a longitudinal spacing (27) to be defined in the main direction (10) between two adjacent fin folds (14) of a corrugated fin (11) of the said adjacent corrugated fins (11), and/or wherein the fin offset (17) amounts to maximally 50% of a longitudinal spacing (27) to be defined in the main direction (10) between two adjacent fin folds (14) of a corrugated fin (11) of the said adjacent corrugated fins (11).

Numbered Paragraph 5. The fin device (9) according to any one of the preceding Numbered Paragraphs, characterised in that by way of the said fin offset (17) on or in the region of a boundary surface (18) formed between corrugated fins (11) that are adjacent in the transverse direction (16), a drainage region (19) for discharging condensate is realised on the adjacent corrugated fins (11).

Numbered Paragraph 6. The fin device (9) according to any one of the preceding Numbered Paragraphs, characterised in that the interconnected fin folds (14) of corrugated fins (11) that are adjacent in the transverse direction (16) comprise or realise at least one of the following characteristics:

they are arranged on a first large side (21) of the fin device (9), which is defined or formed by a component depth (22) viewed in the transverse direction (16) of the fin device (9) and a component depth (23) of the fin device (9) viewed in the main direction (10), they are additionally arranged on a second large side (24) arranged opposite with respect to the first large side (21) of the fin device (9), they lie in a common plane (25), which is optionally parallel to the main direction (10) and further optionally orthogonally to the first large side (21) and to the second large side (24).

Numbered Paragraph 7. The fin device (9) according to any one of the preceding Numbered Paragraphs, characterised in that the fin walls (12) that are adjacent in the transverse direction (16) of corrugated fins (11) that are adjacent in the transverse direction (16) delimit a gap (26) between them.

Numbered Paragraph 8. The fin device (9) according to any one of the preceding Numbered Paragraphs, characterised in that the corrugated fins (11) are manufactured from an integral sheet metal material or a layer composite material, in particular from a sheet metal composite layer material manufactured from individual sheet metal layers.

Numbered Paragraph 9. The fin device (9) according to any one of the preceding Numbered Paragraphs, characterised by an even number of corrugated fins (11), or an uneven number of corrugated fins (11).

Numbered Paragraph 10. A heat exchanger (1) for transferring heat-energy between two fluid streams, having tubes (3) for fluid arranged between opposite collector boxes (2*a*, 2*b*), which are arranged transversely to their tube longitudinal direction (4) spaced apart from one another in a width direction (5), wherein a first fluid path (6) for a first fluid stream leads through the tubes (3) and round about which a second fluid path (7) for a second fluid stream leads, so that the tubes (3) can be flowed through by the first fluid stream and flowed about by the second fluid stream, having at least one fin device (9) according to the preceding Numbered Paragraphs, which are equipped for transferring heat-energy between the first fluid stream and the second fluid stream, wherein the at least one fin device (9) is arranged in the second fluid path (7) and can be flowed about in a depth direction (8) extending transversely with respect to the tube longitudinal direction (4) and the width direction (5), which is parallel to the transverse direction (16), wherein the at least one fin device (9) is connected to at least one tube (3) or with its main direction (10) is oriented parallel to the tube longitudinal directions (4), is positioned between two tubes (3) that are adjacent in the width direction (5) and connected to the same.

Numbered Paragraph 11. A method for manufacturing a fin device (9) according to the Numbered Paragraphs 1 to 9, comprising a roll-forming step and/or a stamping step.

The invention claimed is:

1. A heat exchanger for transferring heat-energy between two fluid streams, comprising a plurality of tubes for fluid arranged between opposite collector boxes, the collector boxes are each arranged transversely to a tube longitudinal direction, the tubes are spaced apart from one another in a width direction, wherein a first fluid path for a first fluid stream leads through the plurality of tubes and a second fluid path for a second fluid stream leads about the plurality of tubes, so that the plurality of tubes are configured to be flowed through by the first fluid stream and flowed about by the second fluid stream, further comprising at least one fin device, which is equipped for transferring heat-energy between the first fluid stream and the second fluid stream, wherein each fin device of the at least one fin device comprises a plurality of corrugated fins that are adjacent to each other and connected to each other, wherein the adjacent and connected corrugated fins are arranged to be lined up and behind one another and connected to each other in a depth direction that is transverse to the tube longitudinal direction and the width direction, wherein each of the plurality of corrugated fins comprise fin walls that are separated by fin folds, wherein the fin folds of adjacent corrugated fins are fixed to one another in that corrugated fins are each connected to one another by fin folds that are adjacent in the depth direction being directly connected to one another;

wherein the at least one fin device is arranged in the second fluid path and can be flowed about by the second fluid stream in the depth direction, wherein the at least one fin device is connected to at least one tube or with a main direction of the at least one fin device oriented parallel to the tube longitudinal direction, wherein the at least one fin device is positioned between two tubes of the plurality of tubes that are adjacent in the width direction.

2. The heat exchanger for transferring heat energy between two fluid streams of claim 1, wherein the corrugated fins each comprise fin walls with louvres and the fin folds, wherein fin walls that are adjacent in the main direction each delimit or form a fluid channel, wherein the corrugated fins are lined up one behind the other, so that the fluid channels of the connected corrugated fins lead into one another, as a result of which the connected corrugated fins are configured to be flowed about by the second fluid stream in the transverse direction, and wherein connected corrugated fins that are adjacent in the transverse direction are arranged offset to one another in the main direction by the spacing referred to as fin spacing.

3. The heat exchanger for transferring heat energy between two fluid streams of claim 1, wherein each fin device of the at least one fin devices forms an integral unit.

4. The heat exchanger for transferring heat energy between two fluid streams of claim 2, wherein a fin offset is defined as a spacing in the main direction between two adjacent interconnected fin folds of corrugated fins that are adjacent in the transverse direction and are connected to each other, wherein the fin offset is a distance that is at least 25% of a distance of a longitudinal spacing in the main direction between two adjacent fin folds of a corrugated fin of the said adjacent corrugated fins, and/or wherein the fin offset amounts to is a distance that is maximally 50% of the longitudinal spacing between two adjacent fin folds of the corrugated fin of the said adjacent corrugated fins.

5. The heat exchanger for transferring heat energy between two fluid streams of claim 4, wherein a drainage region for discharging condensate is realized on the adjacent corrugated fins by way of the said fin offset on or in the region of a boundary surface formed between corrugated fins that are adjacent in the transverse direction.

6. The heat exchanger for transferring heat energy between two fluid streams of claim 1, wherein the fin folds of corrugated fins that are adjacent in the transverse direction and fixed to each other comprise or realize at least one of the following characteristics:

the interconnected fin folds are arranged on a first large side of the fin device, which is defined or formed by a component depth viewed in the depth direction of the fin device and a component depth of the fin device viewed in the main direction, the interconnected fin folds are additionally arranged on a second large side arranged opposite with respect to the first large side of the fin device, and the interconnected fin folds lie in a common plane, which is parallel to the main direction and further orthogonally to the first large side and to the second large side.

7. The heat exchanger for transferring heat energy between two fluid streams of claim 1, wherein the fin walls that are adjacent in the transverse direction of corrugated fins delimit a gap between them.

8. The heat exchanger for transferring heat energy between two fluid streams of claim 1, wherein the corrugated fins are formed from an integral sheet metal material or from a sheet metal composite layer material manufactured from individual sheet metal layers.

9. The heat exchanger for transferring heat energy between two fluid streams of claim 1, wherein the plurality of corrugated fins are an even number of corrugated fins.

10. The heat exchanger for transferring heat energy between two fluid streams of claim 1, wherein the plurality of corrugated fins are an odd number of corrugated fins.

* * * * *